US010238261B2

(12) United States Patent
Genoa et al.

(10) Patent No.: US 10,238,261 B2
(45) Date of Patent: Mar. 26, 2019

(54) STEAMER FOR REMOVING GUM AND THE LIKE FROM VARIOUS SURFACES

(71) Applicant: Gumwand Inc., Farmingdale, NY (US)

(72) Inventors: Scott Genoa, Merrick, NY (US); Shihui Xu, Beijing (CN)

(73) Assignee: GUMWAND, INC., Farmingdale, NY (US)

( * ) Notice: Subject to any disclaimer, the term of this patent is extended or adjusted under 35 U.S.C. 154(b) by 530 days.

(21) Appl. No.: 14/776,023

(22) PCT Filed: Mar. 12, 2014

(86) PCT No.: PCT/US2014/023975
§ 371 (c)(1),
(2) Date: Sep. 14, 2015

(87) PCT Pub. No.: WO2014/159513
PCT Pub. Date: Oct. 2, 2014

(65) Prior Publication Data

US 2016/0022110 A1 Jan. 28, 2016

Related U.S. Application Data

(60) Provisional application No. 61/784,389, filed on Mar. 14, 2013, provisional application No. 61/845,578, filed on Jul. 12, 2013.

(51) Int. Cl.
*A47L 11/40* (2006.01)

(52) U.S. Cl.
CPC ..... *A47L 11/4086* (2013.01); *A47L 11/4036* (2013.01)

(58) Field of Classification Search
CPC ..... A47L 11/4036
See application file for complete search history.

(56) References Cited

U.S. PATENT DOCUMENTS

| | | | | |
|---|---|---|---|---|
| 4,327,459 | A * | 5/1982 | Gilbert | A47L 11/34 15/321 |
| 6,031,969 | A * | 2/2000 | Burr | A47L 1/08 15/320 |
| 6,571,421 | B1 * | 6/2003 | Sham | A47L 5/28 15/320 |
| 8,595,892 | B1 * | 12/2013 | Everette, Jr. | A47L 11/405 15/319 |
| 2001/0034922 | A1 * | 11/2001 | Ko | A47L 7/04 15/320 |
| 2005/0279293 | A1 * | 12/2005 | Vaughan | A01M 15/00 122/36 |
| 2013/0312212 | A1 * | 11/2013 | Kowalski | F22B 27/04 15/322 |

(Continued)

*Primary Examiner* — David Redding
(74) *Attorney, Agent, or Firm* — Law Office of Gerard F. Dunne, PC; Gerard F. Dunne

(57) ABSTRACT

A self-contained device capable of steam cleaning and removal of residue such as chewing gum and the like from surfaces is portable and well balanced so that one person can remove residue of chewing gum or the like in just a couple of seconds. The device includes an elongated housing having wheels on a lower end portion and a handle on an upper portion and the cleaning solution to be turned into steam is heated quickly by a gas burner after being preheated at several stages.

13 Claims, 4 Drawing Sheets

(56) References Cited

U.S. PATENT DOCUMENTS

| | | | | |
|---|---|---|---|---|
| 2014/0053364 | A1* | 2/2014 | Vasudeva | A01M 7/00 15/322 |
| 2016/0106288 | A1* | 4/2016 | Hess | A47L 11/4008 134/18 |

* cited by examiner

STEAMER FOR REMOVING GUM AND THE LIKE FROM VARIOUS SURFACES

CROSS REFERENCE TO RELATED APPLICATIONS

This application is based on provisional application Ser. No. 61/784389 filed Mar. 14, 2013.

FIELD OF THE INVENTION

The present invention relates to a self-contained and maneuverable device using a cleaning solution formed into steam to remove residue of chewing gum and the like, or stain residue, from horizontal surfaces, including both hard surfaces such as paving or sidewalks, and soft surfaces such as a carpet.

BACKGROUND OF THE INVENTION

Several devices have been proposed to remove stains or chewing gum and other products such as oil, tar and the like which can form a residue that can adhere stubbornly to outdoor surfaces such as sidewalks, as well as indoors on carpeting or flooring. It is often desired to remove stubbornly adhered products such as discarded chewing gum, particularly in many areas traveled by persons on foot, as in the front of restaurants, pedestrian malls, inside a stadium, or on a busy shopping street. Also, stains on outdoor surfaces or on indoor carpeting also are desirable to be removed.

The present invention provides a self contained and easily maneuverable cleaning machine creating a steamed cleaning solution to be applied to the residue or stain to be removed, but does not require external power and is well balanced so as to be easily portable and capable of use by a single person in a variety of locations.

Chewing gum traditionally has a base of hydrocarbon polymers mixed with sugar and flavorings, and when such gum is chewed, the inner temperature of the mouth results in softening of the gum while the sugar and flavorings are released. The softened base is often discarded onto the ground where it will adhere tightly afterward, and with time the gum residue will often blacken and become rather unsightly. And, as we know, people will often step on discarded gum and carry the gum waste to adhere in another place.

It has been well understood that a heated cleaning agent can be used to remove such gum residue and similar waste; but prior removal devices typically require connection to external power, are cumbersome, and often time consuming to use.

There have been many proposals to remove such waste as chewing gum residue. One such device is disclosed in United Kingdom patent application no. GB 2491661 published Dec. 12, 2012 describing a self contained cleaning apparatus having containers for fuel and cleaning solution to be carried as a backpack or mounted on a trolley. The cleaning solution and fuel are delivered to a wand to be carried by the user wherein the cleaning solution is heated by a gas burner.

Another device, disclosed in U.S. Pat. No. 7,100,540, describes a portable steam and heat generator using a backpack or truck bed for carrying a solution and fuel to be delivered to an applicator wand heating the solution to develop steam by passing the solution through a coiled pipe to be heated. Though not necessarily a steam cleaning device; this device does demonstrate structures attempting to heat a solution quickly, and near the final application of the heated solution.

Similarly, published United States patent applications nos. US 2002/0026954 and US 2011/0232685 disclose cleaning methods and apparati having a hand held wand connected to a separate transport for fuel and cleaning solution.

It has also been proposed to remove residual chewing gum by use of cryogenic or extremely cold gas to spray onto the gum residue to freeze the residue, but it is not easy to move all of the gum residue without undue scrubbing. Also, use of a flame to burn the gum residue has been proposed. Such techniques, however, are not generally safe to use, especially in public places. Use of hot or steaming water with a chemical cleaning agent added has also been proposed, but such devices typically will use a lot of water and may cause unwanted pollution.

OBJECTS OF THE PRESENT INVENTION

It is, therefore, an object of the present invention to provide a self-contained and easily portable device that can be operated easily by one person to remove chewing gum residue, or other waste product adhered to a surface, or even stains, quickly and effectively.

It is another object of the present invention to provide a cleaning device that is not only self-contained, but well balanced, so that one person by using a handle on one end of the device can guide a brass or nylon brush at the opposite end against the residue of chewing gum or the like for just a couple of seconds, firstly to heat the residue with the steam of a cleaning solution, and then by agitation, to remove the residue quickly and effectively.

And it is a further object of the present invention to provide such a cleaning device that efficiently can heat the cleaning solution to vaporize it into steam quickly, yet remain a self contained, portable and easily maneuverable device.

It is desired, therefore, to provide a device that in practice can create steam of a cleaning solution to be applied through a scrubbing bush by a well-balanced and maneuverable machine so that pressure can be supplied easily to the brush delivering the steam, and in this way, remove such items as chewing gum residue in as little as 2 or 3 seconds.

SUMMARY OF THE PRESENT INVENTION

According to the present invention, a self-contained steam cleaning device capable of steam cleaning and removal of residue such as chewing gum and the like from surfaces, includes an elongated housing preferably having wheels on a lower end portion and a handle on an upper portion, preferably an ergonomic handle, to enable the housing to be moved relatively easily by a single user. A reservoir for a cleaning solution, preferably an environmentally benign sugar solution, or a known cleaning solution such as Gum Remover Solution sold by Merlin Chemicals Ltd. of Liphook, Hants, of the United Kingdom, is provided within a lower portion of the housing. The upper portion of the housing receives a tank for gas, preferably propane, that with the lower reservoir enables the device to be balanced easily upon the wheels when in use.

A vaporizing zone including a gas burner is preferably isolated within the reservoir for delivering heat to convert the cleaning solution into a steam. By placing the vaporizing zone within the reservoir for the cleaning solution, the reservoir serves as a heat exchanger with the vaporizing zone to both preheat the cleaning solution within the reservoir and to dissipate unwanted heat from the vaporizing zone.

Conduit structures including a pump are provided for connecting the reservoir to the vaporizing zone to deliver the cleaning solution to the vaporizing zone. Conduit structures are also provided between the gas tank for connecting the gas tank to the gas burner in the vaporizing zone. Lastly, a brush is connected by conduit structure to the vaporizing zone and located externally at the lower end of the housing for receiving the steamed cleaning solution and applying it to the gum residue or the like. The brush can be made of a material such as brass for cleaning harden surfaces such as concrete, or nylon for use indoors on such items as carpeting or flooring.

In preferred form, the reservoir includes a silica cloth insulation to aid in serving as a heat exchanger with the vaporizing zone.

Air for the combustion is drawn in from a front opening in the housing near the gas burner and escapes from a rearward opening. It is preferred that the pump delivering the cleaning solution to the vaporizing zone be a battery-powered peristaltic pump providing a constant fluid pressure sufficient to drive the steam produced in the vaporizing zone to an escape tube leading to the brush. With the well balanced device, the brush can be moved across the residue by simple movement with the attached wheels to quickly remove the residue; often within 2 or 3 seconds.

It is contemplated that the cleaning solution delivered to the vaporizing zone be the entire cleaning solution to be used for removing the residue so that no ancillary cleaning solutions need be used.

By use of a device according to the present invention, chewing gum residue or similar products adhering to a surface can be cleaned easily by a single person without the need for ancillary power sources.

Thus, removal of such residues can be completed in areas where there is not any external source of power; or the need to provide long power cords or separate trolleys or carts for the equipment.

In operation, the gas is ignited by a piezo ignition switch after the pump has been switched on to ensure that the cleaning solution is inside the vaporizing coil. The flow is adjusted so that there is steam escaping from the nozzle and a slight hot water drip as well. A 2 liter reservoir can be used that will typically last between 1.5-2 hours depending on the required flow rate.

Batteries are provided for the pump and ignition; and the device may be made in two sections connected by a hinge to enable the device to be folded into a compact condition for storage and transportation.

These and other objects, and advantages and features of the present invention will become apparent from the description given below which is made in conjunction with the following drawing figures:

DETAILED DESCRIPTION OF THE DRAWINGS

Figure 1:
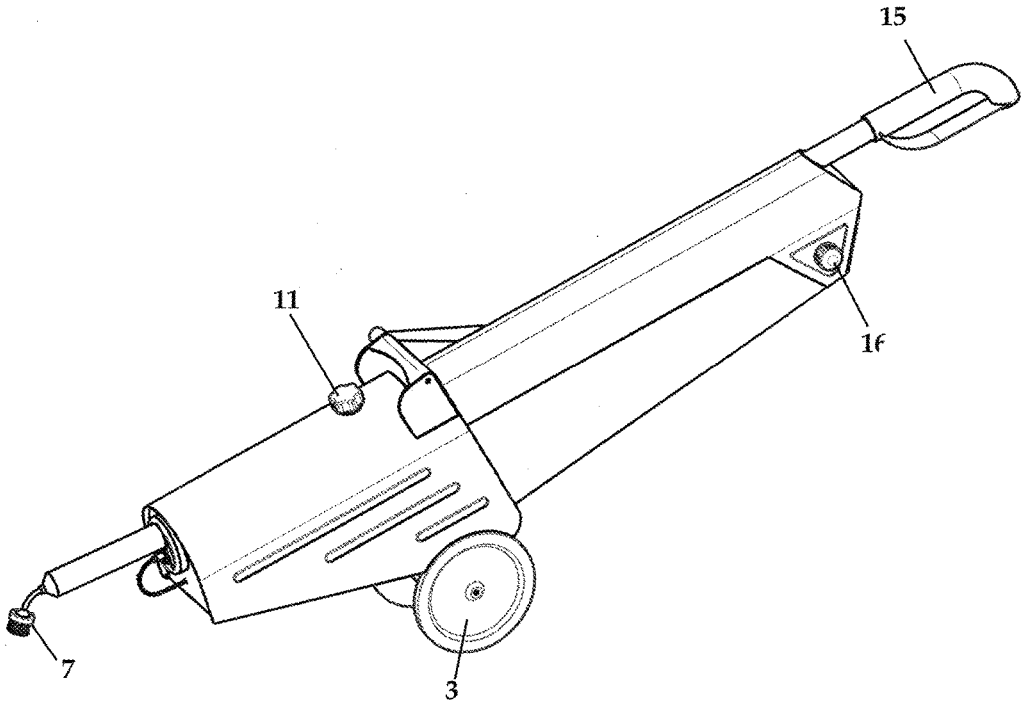
FIG. 1 is a prospective view of a self-contained steam cleaning device of the present invention.

The device is shown in FIG. 1, and one person can operate the device by using the ergonomic handle 15 to guide the device so that the brass or nylon brush 7 at the opposite end can be held onto a residue of chewing gum or the like for a couple of seconds, firstly to heat the gum with the steam of a cleaning solution, and then by agitation to remove the gum.

Figure 2:
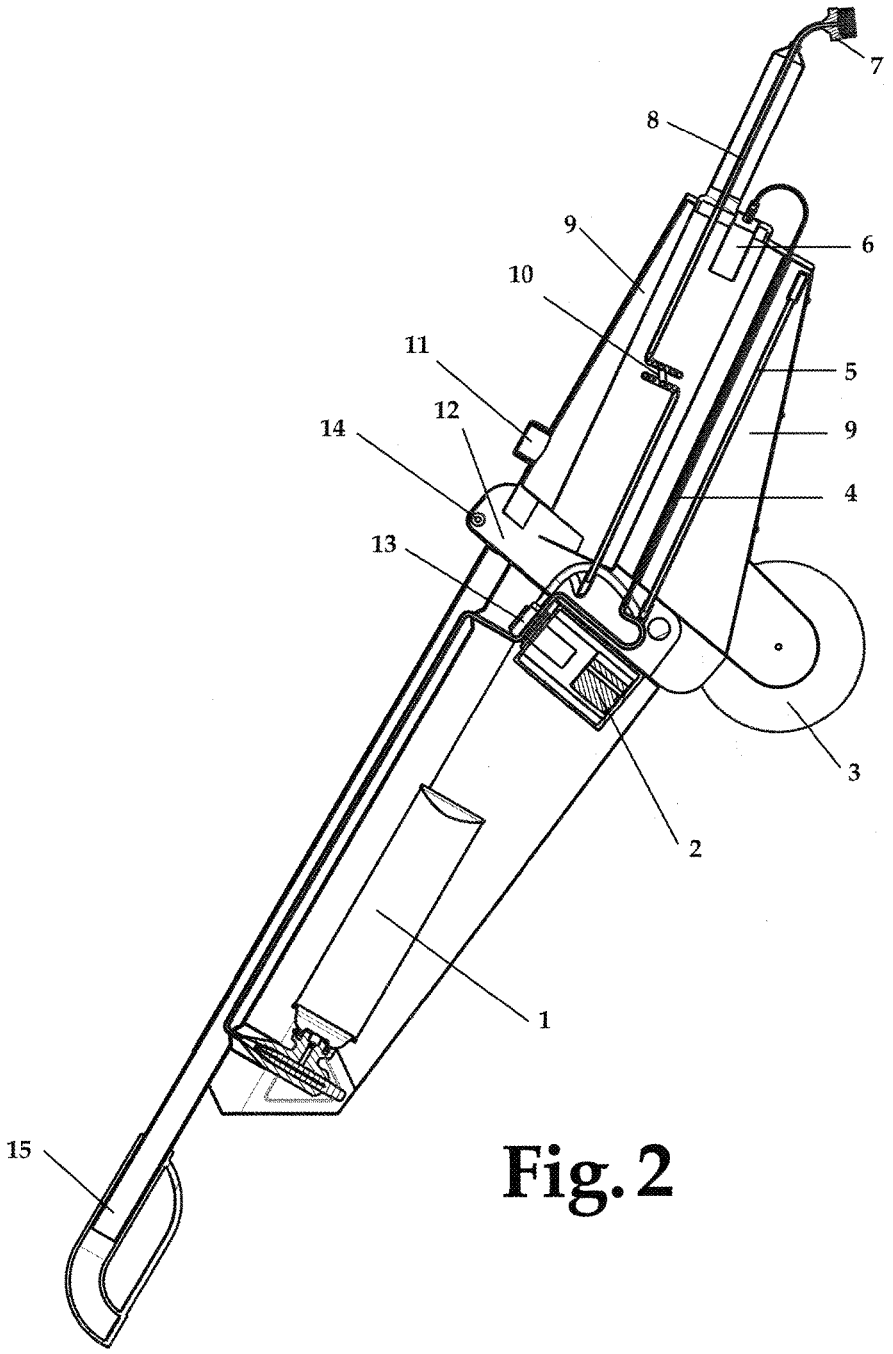
FIG. 2 illustrates the internal components thereof.

A cleaning solution from reservoir 9 shown in the cutaway of FIG. 2 is pumped through conduit 5 to a small metal coil 10 of tubing that is then heated by a burner 6 fed by gas supply pipe 4 from a gas supply 1 of butane or propane to vaporize the cleaning solution. Pump 13 pressurizes the conduits for the cleaning solution so that it is fed as a heated steam through reduced-diameter exit pipe 8 to the brush 7 where, with agitation, the user can soften the chewing gum residue (if it has hardened) and remove it. Or, similarly, remove stains.

For cleaning gum residue, the cleaning solution preferred is Gum Remover Solution sold by Merlin Chemicals Ltd. of Liphook, Hants, the United Kingdom; or a simple sugar solution has also been found effective.

The reservoir 9 for the cleaning solution has a silica cloth insulation, and is in the lower section of the device and is formed in two sections formed around the heating chamber serving as the vaporizing zone of the device.

In this way, the reservoir 9 holding the cleaning solution acts as a cooling medium to take some of the unwanted heat away from the heating chamber after the coil 10 is heated by the burner 6; and can serve to preheat the cleaning solution in the reservoir 9. The coil 10 can be shaped in a spoon-like manner so the turns of the coil have a reducing diameter as they extend from the flame, and this allows the flame to apply heat to more surface area on the shaped coil. An opening 12 serves as an exit for heat from the combustion area.

Figure 4:
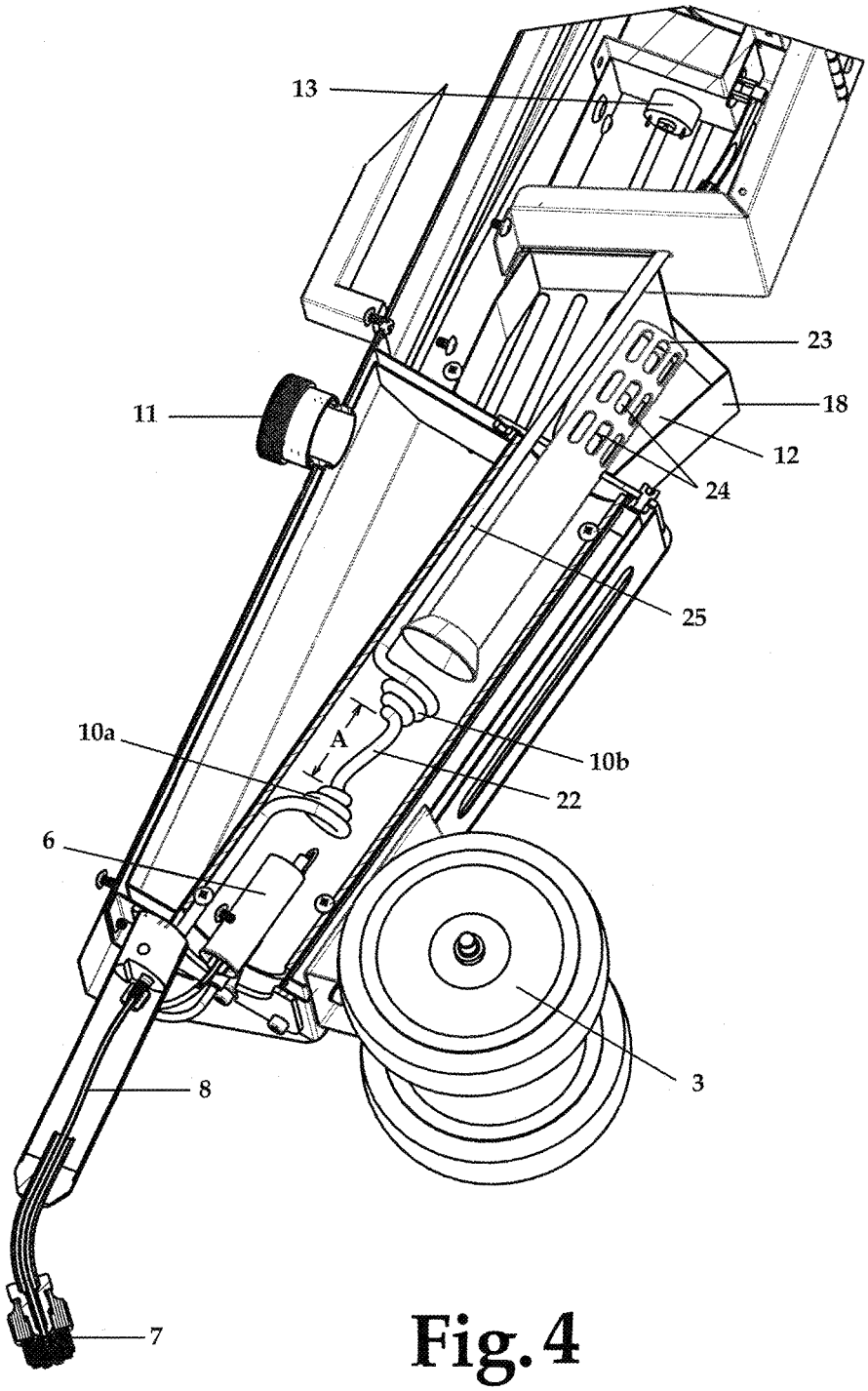
FIG. 4 illustrates an alternate embodiment of the internal components.

The distance from the burner 6 and the coil 10 is set so the flame is able to vaporize the cleaning solution quickly. A spacing of 24.54 mm for the geometry and dimensions shown in FIG. 4 has been found effective. FIG. 4 illustrates an embodiment for the internal structures wherein the spacing A-A for the two coils 10*a* and 10*b* is 100 mm to exemplify the geometry.

Due to the fact that the pump 13 is continually pushing the cleaning solution into the coil 10, the steam will find the easiest access point which is the escape tube 8 leading to the brush 7. The escape tube 8 has a reduced diameter to increase the volume of the steam flow. The pump 13 preferably is a peristaltic pump to ensure a small and consistent flow is carried to the coil 10. If a diaphragm type pump were used, it may cause the cleaning solution to foam and give an inconsistent flow to the coil 10.

Air for the combustion is drawn in from a front opening in the housing behind the burner 6 and escapes from a side opening 12. As shown in FIG. 4, a wind baffle 18 may be provided in a lower region of the housing serving as the exhaust to prevent back flow of air that may inadvertently cool the vaporizing zone or possibly extinguish the flame from the gas burner, or direct it away from the coil.

In operation, the fuel is ignited by a piezo ignition switch after switching on the pump to ensure that the cleaning solution is inside the coil 10. The flow is adjusted so that approximately there is steam escaping from the nozzle and a slight drip as well, and a flow of 16-20 ml/minute has been found to be successful in providing steam and a drip of hot cleaning solution.

A 2 liter tank will last between 1.5-2 hours depending on the required flow rate.

Batteries 2 are provided for the pump and ignition; and wheels 3 enable the device of the present invention to be maneuverable.

The reservoir for the cleaning solution can be filled through removable cap 11 and a control for the flow of fuel is actuated by knob 16 controlling a needle valve.

Figure 3:
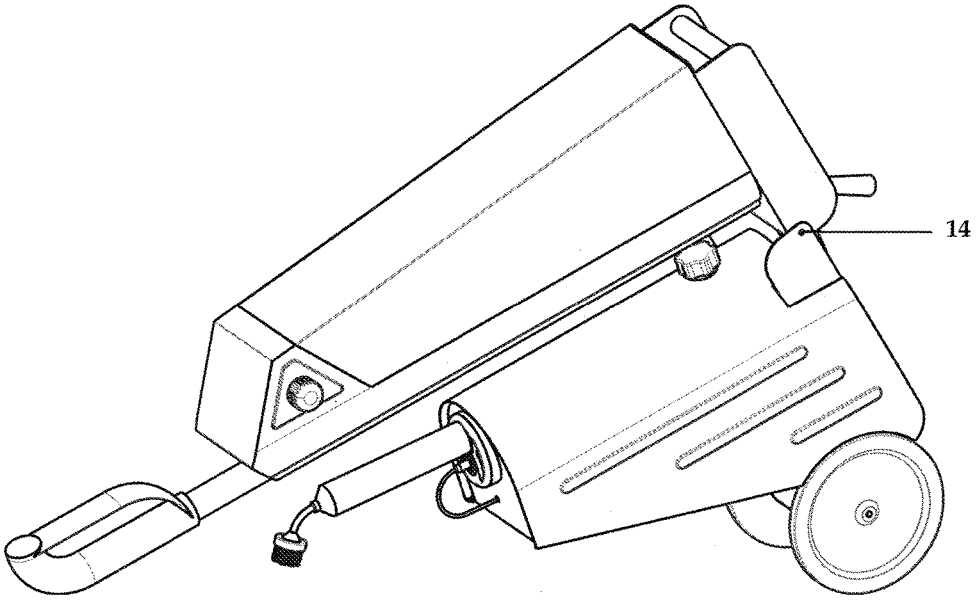
FIG. 3 illustrates the device of FIG. 1 in its hinged condition.

The device may be made in two sections connected by hinge 14 to enable the device to be folded into a compact condition, as shown in FIG. 3, for storage and transportation.

The gas, typically propane, is delivered through a micro adjustment inlet to regulate the gas pressure.

In the embodiment of FIG. 4, the vaporizing zone includes the gas burner 6, coils 10*a* and 10*b*, and a non-linear conduit portion or exhaust tube 22. The interconnected coils 10*a* and 10*b* form a pipe assembly delivering the cleaning solution from reservoir 9 to the gas burner 6. To increase efficiency in heating the cleaning solution quickly to steam, this pipe assembly includes a first coil portion 10*a* serving as a vaporizing coil having the radius of turns diminishing to form a generally frustroconical configuration. The gas burner 6 is positioned centrally adjacent the portion of the vaporizing coil 10*a* with the larger radius with the diminishing turns leading away from the gas burner 6. In this way, the flame from the burner can heat a greater surface area of the pipe assembly containing the cleaning solution to be vaporized.

To further increase efficient of the vaporization of the cleaning solution to steam, the pipe assembly includes conduit portion 22 leading to the turns of the vaporizing coil 10*a* having the smaller radius for delivering the cleaning solution to the vaporizing coil, and a heat-exchanging second coil 10*b* for delivering the cleaning solution to the conduit portion 22. The heat-exchanging second coil 10*b* has the radius of turns increasing from the conduit portion to form a generally frustroconical configuration, and receives the cleaning solution through conduits from the reservoir 9.

The heat-exchanging second coil 10*b* is located to receive the exhaust from the gas burner 6 as it enters the exhaust tube 22. In this way, the cleaning solution is preheated within heat-exchanging coil 10*b* before being delivered to the vaporizing coil 10*b*. Thus, the cleaning solution is preheated in the reservoir due to the vaporizing zone being located within the reservoir, and the exhaust leading to heat-exchanging coil 10*b*. The conduit portion 22 also serves as a heat exchanger with the exhaust from the gas burner to preheat the cleaning solution further just before it enters the vaporizing coil 10*a*.

In this way, the cleaning solution is preheated to provide a very quick transition to steam in the vaporizing coil.

It is contemplated that the cleaning solution delivered to the vaporizing zone be the entire cleaning solution to be used for removing the residue so that no ancillary cleaning solutions need be used.

The exhaust tube 22 as shown in FIG. 4 has venting holes 24 at its end portion downstream of the burner 6, and the end portion is closed off by a rear wall 23. With baffle 18, these structures for the exhaust tube protect against back drafts when the device is used outdoors in windy conditions. The exhaust from the burner 6 will flow outwards through the holes 24 and out through vents in the walls of the housing.

Further, a portion 25 of the conduit delivering the cleaning solution to the vaporizing zone extends along the exhaust tube 22 to further serve as a heat exchanger receiving heat from the exhaust tube to preheat the cleaning solution.

What is claimed is:

1. A self-contained steam cleaning device for removing residue such as stains, chewing gum and the like from surfaces with a heated cleaning solution without the need for external power, including an elongate housing adapted to be balanced upon two wheels to be attached respectively on opposite sides of a forward portion of said housing, said housing containing a reservoir adapted to receive the cleaning solution to be used for removing chewing gum and the like, a vaporizing zone within said housing for delivering heat to convert said cleaning solution into steam, conduit structure within said housing including a pump for connecting said reservoir to said vaporizing zone to deliver said cleaning solution to said vaporizing zone, and a cleaning element connected externally to said forward portion of said housing by conduit structure extending to said vaporizing zone for receiving the steam of the cleaning solution to be used and applying it to the material to be removed, said housing adapted to receive a self-contained power source, said vaporizing zone including a heat source connected to said self-contained power source and a pipe assembly formed as a portion of said conduit structure for delivering said cleaning solution to said heat source, said housing being adapted to be positioned upon said two wheels to be attached respectively on opposite sides of said housing to locate said cleaning element in a position upon the surface area to be cleaned with the operator able to apply a desired pressure to said cleaning element from the weight of said device by manipulating the device on said wheels.

2. A self-contained steam cleaning device as set forth in claim 1, said reservoir being located within one end portion of said housing and said self-contained power source being located in the other end portion of said housing.

3. A self-contained steam cleaning device as set forth in claim 2, said self-contained power source being a gas tank and said heat source being a gas burner.

4. A self-contained steam cleaning device as set forth in claim 3, said pipe assembly including a portion formed as a vaporizing coil having the radius of turns diminishing to form a generally frustroconical configuration, said burner positioned centrally adjacent the portion of the vaporizing coil with the larger radius with the diminishing turns leading away from said burner, and said pipe assembly further including a conduit portion leading to the turns of said coil having the smaller radius for delivering said cleaning solution to the vaporizing coil and a heat-exchanging second coil for delivering said cleaning solution to said conduit portion, said heat-exchanging second coil having the radius of turns increasing from conduit portion to form a generally frustroconical configuration and located to receive the exhaust from said gas burner to preheat cleaning solution being delivered to said vaporizing coil.

5. A self-contained steam cleaning device as set forth in claim 4, further including an exhaust tube extending away from said heat-exchanging second coil.

6. A self-contained steam cleaning device as set forth in claim 4, said conduit structure connecting said reservoir to said vaporizing zone including a heat absorbing portion extending along said exhaust tube.

7. A self-contained steam cleaning device as set forth in claim 5, said housing having an opening adjacent the exit of said exhaust tube, said opening having a baffle deflecting air from the area of said exhaust tube.

8. A self-contained steam cleaning device for removing residue such as stains, chewing gum and the like from surfaces, including an elongated housing having wheels on a lower end portion and a handle on an upper portion to enable said housing to be moved by a single user, a reservoir within a lower portion of said housing and adapted to receive a cleaning solution, a vaporizing zone within said housing for delivering heat to convert said cleaning solution into a steam, conduit structure including a pump for connecting said reservoir to said vaporizing zone to deliver said cleaning solution to said vaporizing zone, an upper portion of said housing adapted to receive a self-contained power source, conduit structure within said housing for connecting said reservoir to said vaporizing zone, and a cleaning element connected by conduit structure to said vaporizing zone and attached externally at a lower portion of said housing for receiving said steam and applying it to the residue to be removed.

9. A self-contained steam cleaning device as set forth in claim 8, the cleaning solution to be received within said reservoir being the entire cleaning solution to be used for removing the residue.

10. A self-contained steam cleaning device as set forth in claim 8, said pump being a peristaltic pump.

11. A self-contained steam cleaning device as set forth in claim 8, said vaporizing zone including a gas burner and a pipe assembly formed as a portion of said conduit structure and located adjacent said burner for delivering said cleaning solution, said pipe assembly including a first coil portion separated by a length of tubing to a second coil portion, said burner positioned centrally adjacent said first coil portion.

12. A self-contained steam cleaning device as set forth in claim 8, said housing being adapted to be positioned upon said two wheels to be attached respectively on opposite sides of said housing to locate said cleaning element in a position upon the surface area to be cleaned with the operator able to apply a desired pressure to said cleaning element from the weight of said device by manipulating the device on said wheels.

13. A self-contained steam cleaning device as set forth in claim 12, said reservoir being located within one end portion of said housing and said self-contained power source being located in the other end portion of said housing.

* * * * *